US010704170B2

(12) United States Patent
Debuf et al.

(10) Patent No.: US 10,704,170 B2
(45) Date of Patent: Jul. 7, 2020

(54) DEVICE EQUIPPED WITH PATTERN-CONTROLLED COMPONENTS AND TEXTILE MACHINE COMPRISING SUCH A DEVICE

(71) Applicant: NV MICHEL VAN DE WIELE, Kortrijk/Marke (BE)

(72) Inventors: Geert Debuf, Drongen (BE); Brecht Halsberghe, Kuurne (BE); Vincent Lampaert, Vichte (BE)

(73) Assignee: NV MICHEL VAN DE WIELE (BE)

( * ) Notice: Subject to any disclaimer, the term of this patent is extended or adjusted under 35 U.S.C. 154(b) by 39 days.

(21) Appl. No.: 15/568,464

(22) PCT Filed: Apr. 19, 2016

(86) PCT No.: PCT/IB2016/052217

§ 371 (c)(1),
(2) Date: Oct. 20, 2017

(87) PCT Pub. No.: WO2016/170472

PCT Pub. Date: Oct. 27, 2016

(65) Prior Publication Data

US 2018/0148868 A1 May 31, 2018

(30) Foreign Application Priority Data

Apr. 22, 2015 (BE) ..... 2015/5264

(51) Int. Cl.
*D03C 13/00* (2006.01)
*D03C 3/20* (2006.01)
(Continued)

(52) U.S. Cl.
CPC ..... *D03C 13/025* (2013.01); *D03C 3/205* (2013.01); *D03D 39/02* (2013.01); *D03J 1/008* (2013.01); *D05C 15/26* (2013.01)

(58) Field of Classification Search
CPC ..... D03C 3/20; D03C 3/205; D05C 15/04; D05C 15/16; D05C 15/26; D03J 1/008
See application file for complete search history.

(56) References Cited

U.S. PATENT DOCUMENTS 3,752,094 A 8/1973 Short
4,545,312 A * 10/1985 Ingram ..... D05C 15/20 112/256
6,058,983 A 5/2000 Bourgeaux

FOREIGN PATENT DOCUMENTS

EP 1 239 068 A1 9/2002

OTHER PUBLICATIONS

International Search Report and Written Opinion dated Sep. 8, 2016.

* cited by examiner

*Primary Examiner* — Nathan E Durham
(74) *Attorney, Agent, or Firm* — Fresh IP PLC; Aubrey Y Chen

(57) ABSTRACT

A device (1) equipped with pattern-controlled components (2) for pattern-controlled feeding and/or selection of yarn for a textile machine, comprising a plurality of actuators (4) and a cooling circuit (5, 8) through which coolant is flowable for the cooling of the actuators (4), whereby the actuators (4) in the device (1) are installed alongside the cooling circuit (5, 8) and are mountable so as to be detachable so that the actuators can be removed without interrupting the cooling circuit (5, 8). Furthermore, a textile machine comprising such a device (1).

17 Claims, 5 Drawing Sheets

(51) Int. Cl.

| | |
|---|---|
| ***D03D 39/02*** | (2006.01) |
| ***D03J 1/00*** | (2006.01) |
| *D05C 15/26* | (2006.01) |

DEVICE EQUIPPED WITH PATTERN-CONTROLLED COMPONENTS AND TEXTILE MACHINE COMPRISING SUCH A DEVICE

This application is a National Phase entry of International Application No. PCT/IB2016/052217 under § 371 and claims the benefit of Belgian patent application No. BE2015/5264, filed Apr. 22, 2015, which is hereby incorporated by reference in its entirety.

FIELD OF THE DISCLOSURE

This disclosure relates to a device equipped with pattern-controlled components for pattern-controlled feeding and/or selection of yarn for a textile machine comprising a plurality of actuators and a cooling circuit through which cooling liquid is flowable for the cooling of the actuators.

This disclosure also relates to a Jacquard machine comprising such a device.

Furthermore this disclosure relates to a textile machine comprising such a device. Such a textile machine can, for example, be a tufting machine, or a weaving machine, which more specifically can be an Axminster weaving machine.

BACKGROUND

Applications with devices to which this disclosure relates are known in various types of textile machine. Precise and delicate patterns and figures are becoming more and more in demand in the production of fabrics and/or carpets. The yarns are sub-divided into ever smaller groups and are together fed and/or selected by a pattern-controlled component in order to obtain the desired result in the fabric and/or carpet. The yarns are even being increasingly individually controlled and/or selected. This leads to a sharp increase in the number of actuators used.

Different versions of such pattern-controlled components can be found in tufting machines. Pattern-controlled components known as "pile feeders" are provided to feed the yarn pattern driven to the tufting needles. Other pattern-controlled components such as pattern-controlled components that control the hooks under the tuft fabric, with or without knives, are provided to determine the pattern-controlled selection of the pile height and/or pile form, namely pile loops or cut pile. Further pattern-controlled components which control the tufting needles directly are provided for the pattern-controlled selection of the yarn to be brought into a base fabric.

A Jacquard machine is equipped with a very large number of pattern-controlled components for pattern-controlled positioning of the yarn. A weaving machine can comprise a Jacquard machine. A weaving machine can also be equipped with pattern-controlled components provided to feed the yarn pattern driven in order in this way to determine the pile height of the piles in the carpet.

In the case of Axminster weaving machines the pattern-controlled components can be provided for pattern-controlled selection of the yarn to be brought into a fabric. Such an Axminster weaving machine then comprises an Axminster Jacquard machine with such pattern-controlled components provided for pattern-controlled selection of the yarn.

The actuators used here can be rotary motors, linear motors, stepper motors, voice-coil actuators, hydraulic or pneumatic actuators, solenoids, etc.

In the different types of textile machines, a large number of these pattern-controlled components are installed in a limited space in the above-mentioned devices. An arrangement often comprises dozens, hundreds or even thousands of actuators. The actuators thereof must hereby be capable of being cooled in an efficient manner.

Today, these actuators are usually cooled with air.

U.S. Pat. No. 6,807,917 B1 describes an example of such a device with yarn feeding modules for feeding yarn into a tufting machine in which the motors are air-cooled. Here a series of fans direct the necessary air over the components to be cooled.

Air as a coolant is less effective, however, than other known cooling fluids. In the area around textile machines, the ambient air is warm and dusty so that filters are necessary to remove the dust from the air. Another possibility is to use outside air as cooling air, but this solution requires additional air pipes. Furthermore, in both cases a large contact area is necessary between the actuators and the air in order to be able to dissipate sufficient heat, and a relatively large flow of air is necessary in order to be able to cool the actuators sufficiently.

In order to overcome the disadvantages of cooling with air, attempts are already being made to cool these actuators with water.

US 2008/0178960 A1 and FR2 944 808 A1 describe a few examples of how motors for a shed forming device can be designed for water cooling.

A major disadvantage here, however, is that in the event of a defect in an actuator so that it has to be replaced, the cooling circuit in which the water is flowing has to be interrupted. This results in the replacement of an actuator being fairly burdensome and time-consuming. Furthermore, the water from the cooling circuit can cause considerable damage in a textile machine.

Such water-cooled actuators are already in use in applications on textile machines with a limited number of actuators installed alongside or under the actual working area of the textile machine, namely the yarn feeding and textile forming zone. The failure percentage of the actuators is relatively limited there and the risks of an interruption of the cooling circuit are more limited there, since the actuators are installed outside the actual working area. In applications to which this invention relates in which dozens, hundreds or even thousands of actuators are installed in a more limited area in the immediate vicinity of the actual working area of the textile machine, and then predominantly above it, however, such water-cooled actuators are barely employed in practice. Due to the large number of actuators, there is a real chance of failure of one of the actuators, and furthermore the risks of consequential damage from the interruption of a water-filled cooling circuit cannot be neglected.

SUMMARY

An object of some embodiments of the present invention is then also to provide a device equipped with pattern-controlled components for pattern-controlled feeding and/or selection of yarn for a textile machine whose actuators can be cooled in an efficient manner without the above-mentioned disadvantages.

This object may be achieved by providing a device equipped with pattern-controlled components for pattern-controlled feeding and/or selection of yarn for a textile machine, comprising a plurality of actuators and a cooling circuit through which cooling liquid is flowable for the cooling of the actuators, whereby the actuators in the device are installed outside the cooling circuit and are mountable so as to be detachable without interrupting the cooling circuit.

By not integrating the actuators into the cooling circuit and installing them completely alongside the cooling circuit so that they are coolable by the cooling circuit and are detachably installable with respect to the cooling circuit without interrupting the cooling circuit, the replacement of one or more of the actuators is less burdensome and less hazardous than with the known water-cooled actuators in which the cooling circuit runs through these actuators themselves. Compared with the known air-cooled actuators, dust-free cooling is now achieved that is also far more efficient. The energy losses from the actuators in the form of residual heat can be discharged with a device according to the invention in a simple, operationally safe and efficient manner. The cooling of the actuators ensures that the actuators and the connected components can operate in a more limited temperature range and hence can be more appropriately dimensioned or that the operational safety of the actuators and the connected components is increased.

In order to permit simple installation of the actuators, such a device is preferably equipped with a mounting frame on which the actuators are detachably installable for detachable installation in the device.

The cooling circuit in such a device is preferably at least partially integrated into the mounting frame to allow compact installation of the cooling circuit in the device. In this way the device can either be designed more compactly, or the components of the device can be installed less closely together within the same volume. The actuators can thus be made more easily attachable to the mounting frame without obstruction from the additional pipework forming the cooling circuit at the points where this cooling circuit is integrated into the mounting frame or in their immediate vicinity. Furthermore, the attachment elements for attaching the actuators to the mounting frame can thus be given the additional function of discharging the heat from the actuators to the cooling circuit.

A cooling circuit can be provided for each mounting frame of such a device. A cooling circuit of such a device can also be installed spread across several mounting frames. The cooling circuit can run through the mounting frames in series or in parallel. It is thus possible, for example, to install one cooling circuit for two mounting frames.

A device according to some embodiments of this invention preferably comprises one or more actuator modules of pattern-controlled components whereby each actuator module comprises one or more said actuators and whereby each actuator module is detachably installable in the device in order to install the actuators contained in said actuator modules detachably in the device. If such a device comprises a said mounting frame, then each actuator module is preferably detachably installable on this mounting frame.

Such a modular construction in which one or more actuators form part of one or more actuator modules simplifies assembly and disassembly.

In such a device with one or more actuator modules, each actuator module preferably comprises one or more thermally conductive elements to conduct heat from the actuators to the cooling circuit.

With the aid of such thermally conductive elements, the heat transfer from the actuators to the cooling circuit can be maximized.

With such embodiments, each actuator module is preferably detachably installable in the device by means of the one or more thermally conductive elements. In this way such thermally conductive elements can provide optimum transfer of the heat. The use of such thermally conductive elements for installation of each actuator allows the number of installation elements required for the installation of each actuator in the device to be limited.

In said devices with one or more thermally conductive elements, each actuator is preferably installed at least partially separate from the one or more thermally conductive elements. At least one part of each actuator does not border on these one or more thermally conductive elements so that each actuator is not surrounded by these one or more thermally conductive elements. This also allows material to be saved because not all sides of the actuator modules have to be covered by such thermally conductive elements.

At least one side of each actuator is hereby preferably installed facing away from the one or more thermally conductive elements. More preferably, each actuator borders on the one or more thermally conductive elements on only one side.

More specifically, each actuator module can comprise a thermally conductive plate as said thermally conductive element. Such a thermally conductive plate can ensure a good heat transfer in combination with a simple installation.

This thermally conductive plate can extend, for example, like a flange relative to each actuator of the actuator module. It can thereby extend like a flange relative to the head of such an actuator.

Furthermore the cooling circuit can more specifically comprise at least one beam through which cooling liquid is flowable and to which each actuator module is detachably fastenable. This is a simple manner for maximizing the heat transfer from the actuators to the cooling circuit by means of such thermally conductive elements.

If the thermally conductive elements comprise such a thermally conductive plate, then this thermally conductive plate is preferably detachably fastenable to a said beam through which cooling liquid is flowable for the detachable fastening of the actuator module to this beam.

In such a device with a said mounting frame where the cooling circuit is at least partially integrated into this mounting frame, this beam can then advantageously form part of the mounting frame.

In order to permit simple installation of the actuators in the device, each actuator module in a specific embodiment of a device according to this invention which comprises a said mounting frame and the one or more said actuator modules has a guide rib or guide slot and the mounting frame comprises a corresponding guide slot or guide rib to guide the actuator module during installation of said module.

A special embodiment of a device according to this invention comprises one or more electrical components, whereby the cooling circuit is provided for cooling these electrical components. These electrical components can comprise i.a. PCBs, electronic circuits, processors, inverters, relays, etc.

If such a device comprises one or more said actuator modules, then each actuator module preferably comprises one or more said electrical components.

Alternatively, but less preferably, these electrical components could also be installed separately from these actuator modules in the device, whereby the actuator modules are installed detachably relative to these electrical components.

All said electrical components are preferably contained in the one or more actuator modules. It is also possible to include part of the electrical components in the one or more actuator modules and to install the other part separately from these actuator modules in the device.

If each actuator module comprises one or more said electrical components, then the actuators of each actuator module are preferably installed on both sides of the electrical components of this actuator module.

In a specific preferred embodiment of a device according to this invention, each actuator module comprises eight said actuators, four installed on each side of the electrical components.

If a device with one or more said electrical components comprises a said thermally conductive plate in each actuator module, then the actuators and the electrical components in each actuator module are preferably fastened to this thermally conductive plate.

The cooling liquid in a preferred device according to this invention can be water or a water-based liquid.

This invention also relates in some embodiments to a Jacquard machine comprising a device equipped with pattern-controlled components, whereby this device is a device as described above, provided for pattern-controlled positioning of yarn.

Furthermore this invention in some embodiments relates to a textile machine comprising a device equipped with pattern-controlled components, whereby this device is a device as described above.

Such a textile machine according to this invention can, for example, be a tufting machine, an Axminster weaving machine or a weaving machine. Such a weaving machine can then more specifically comprise a said Jacquard machine according to an embodiment of this invention.

In a textile machine according to some embodiments of this invention, the cooling circuit is furthermore preferably provided for the cooling of one or more mechanical parts of the device and/or of other mechanical and/or electrical parts of this textile machine.

BRIEF DESCRIPTION OF THE DRAWINGS

This invention is now explained in further detail by means of the following detailed description of an embodiment of a device according to this invention. The purpose of this description is purely to give clarifying examples and to highlight further advantages and specifics of this device and can therefore not be interpreted as a limitation of the field of application of the invention or of the patent rights claimed in the claims.

In this detailed description, reference numbers are used to refer to the attached drawings, wherein.

DETAILED DESCRIPTION

The figures illustrate a yarn feeding unit (1) for a tufting machine with pattern-controlled components (2) for the pattern-controlled feeding of yarn. For a person skilled in the art it is clear from this how, by analogy, he can for example devise a yarn feeding unit for a weaving machine for the pattern-controlled feeding of yarn or how, by analogy, he can devise a selection unit for a tufting machine or weaving machine with pattern-controlled components for pattern-controlled selection of yarn.

The illustrated yarn feeding unit (1) comprises a mounting frame (3, 8) to which various yarn feeding modules (6) are detachably fastened.

Figure 1:
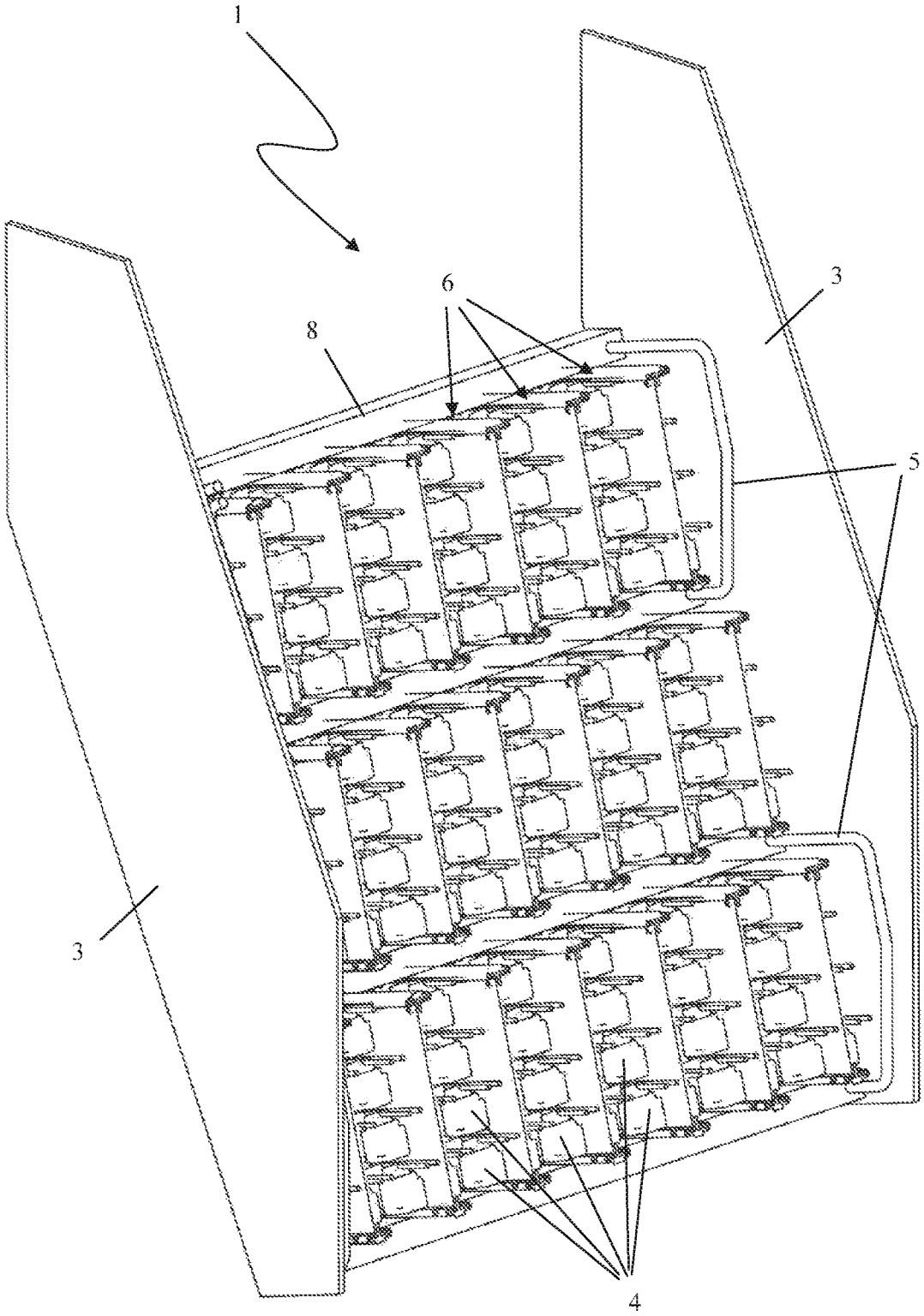
FIG. 1 shows a perspective view of an example of a yarn feeding unit for a tufting machine according to an embodiment of this invention.
Figure 2:
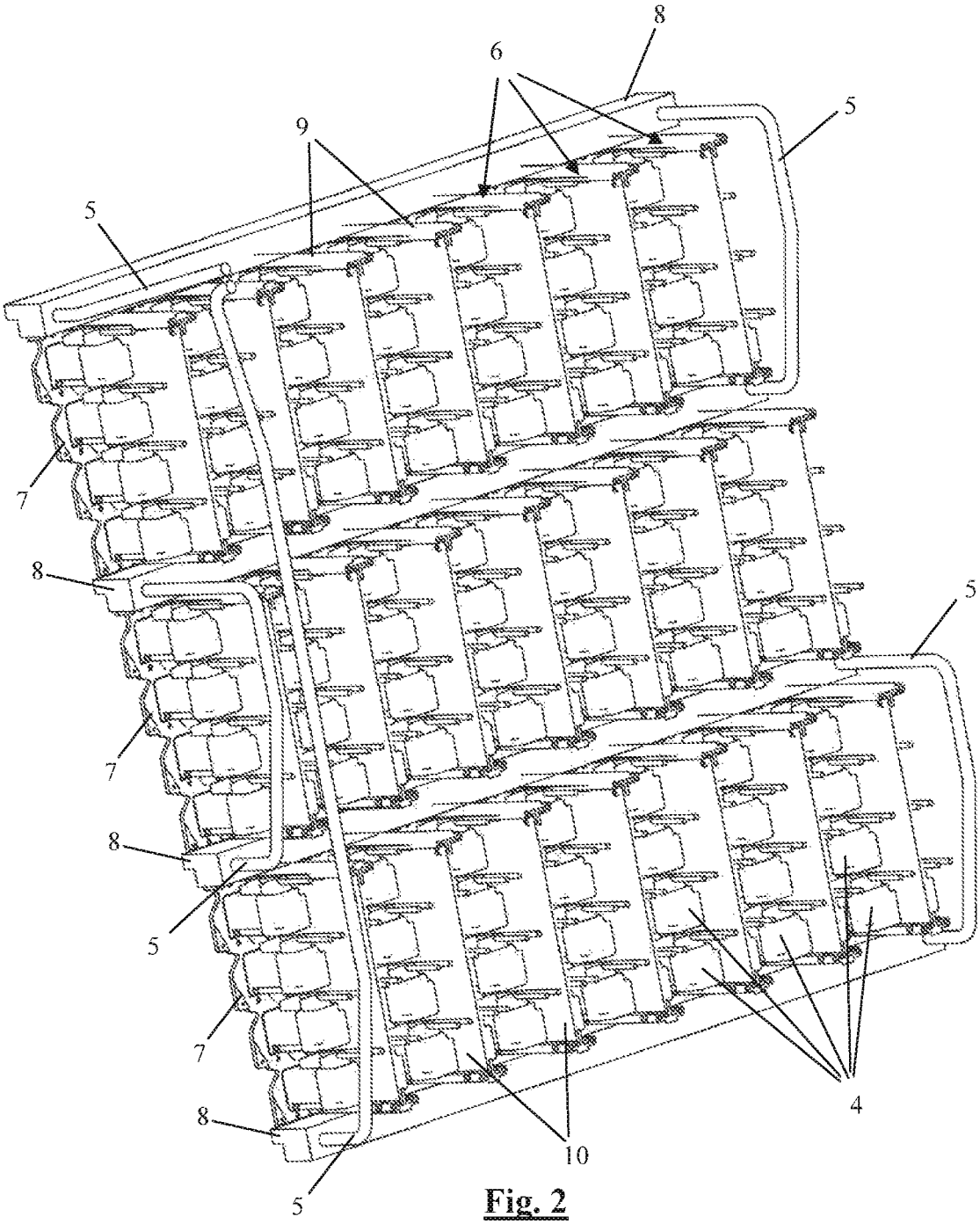
FIG. 2 shows a perspective view of the yarn feeding unit from FIG. 1 without the side walls of the mounting frame for the unit.
Figure 3:
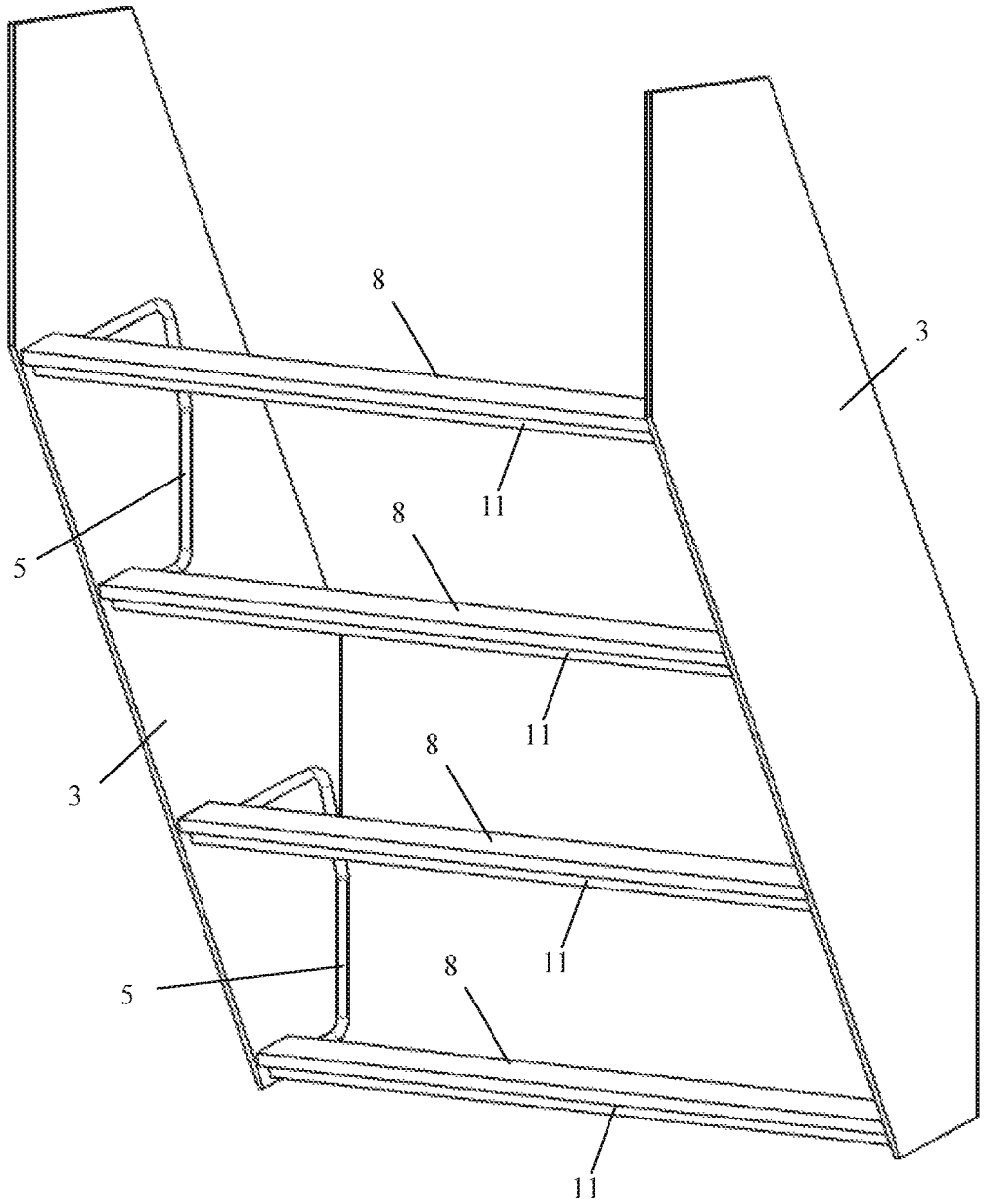
FIG. 3 shows a separate perspective view of the mounting frame and the cooling circuit of the yarn feeding unit from FIG. 1.

As can be better seen in FIG. 3, the mounting frame (3, 8) comprises two side walls (3) between which a number of beams (8) are installed more or less parallel to each other. The beams (8) are hollow and are connected together by pipes (5) to form together a cooling circuit (5, 8) through which water is flowable. In this way this cooling circuit (5, 8) is partially integrated into the mounting frame (3, 8).

Figure 4:
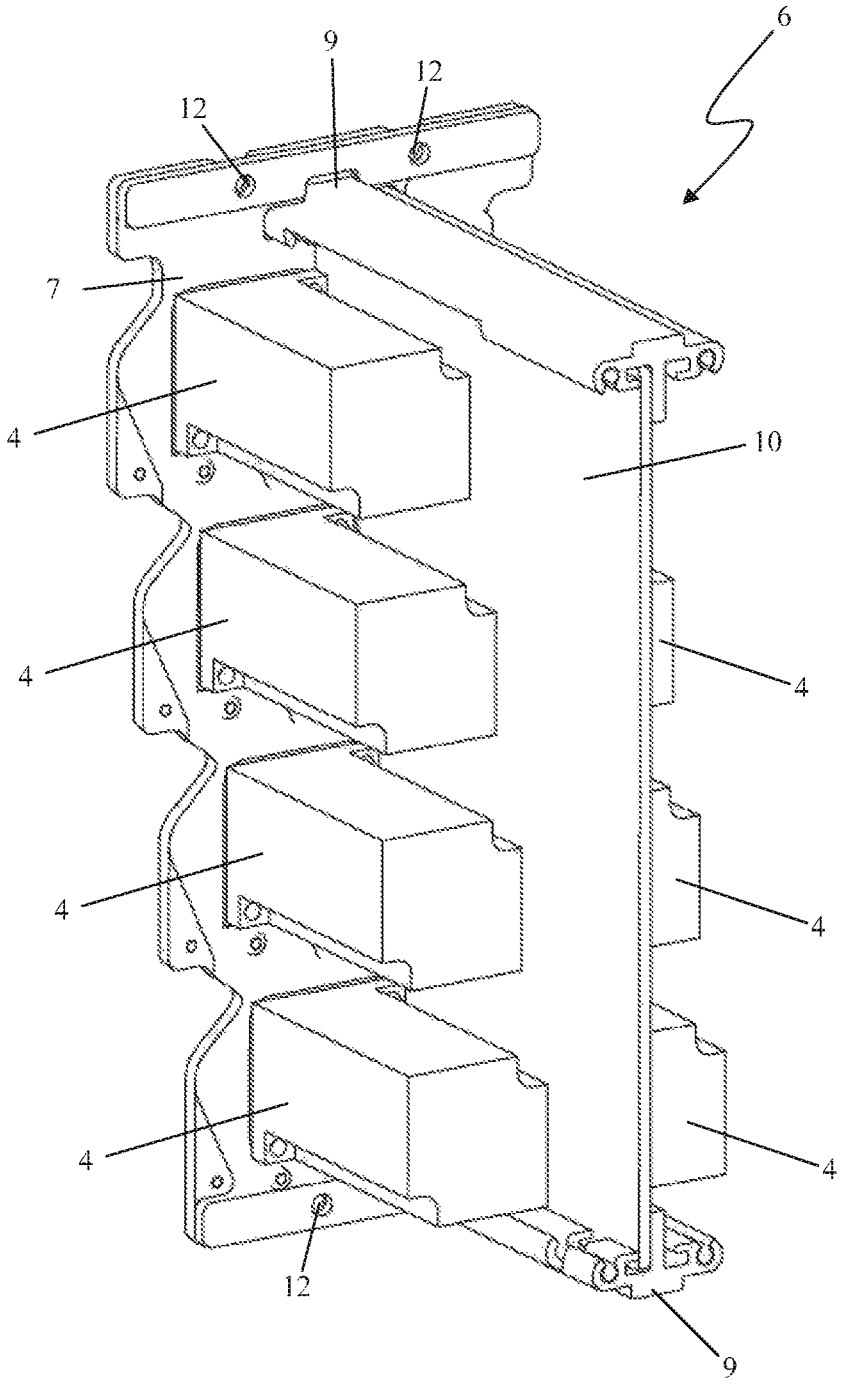
FIG. 4 shows a separate perspective view of a yarn feeding module of the yarn feeding unit from FIG. 1.
Figure 5:
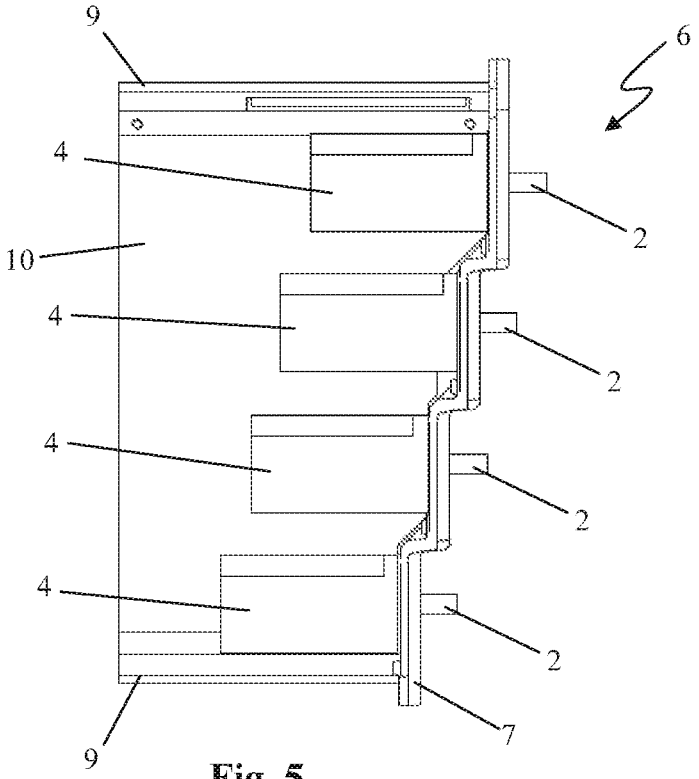
FIG. 5 shows a side view of the yarn feeding module from FIG. 4.
Figure 6:
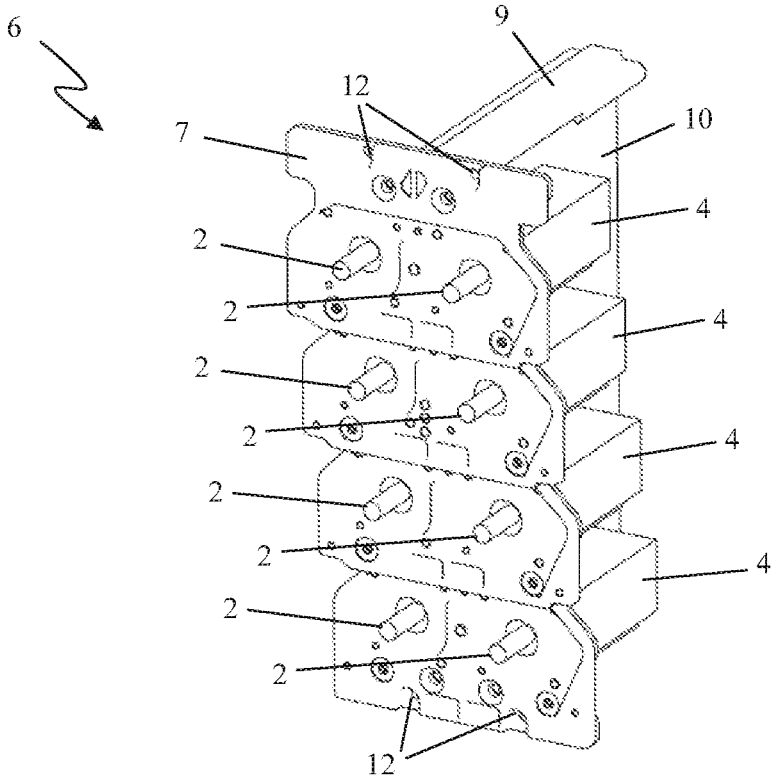
FIG. 6 shows a perspective view of the yarn feeding module from FIG. 4 with a view of the pattern-controlled components.

FIGS. 4-6 show a separate yarn feeding module (6). Each yarn feeding module (6) comprises eight servomotors (4) that are mounted together on a plate (7). Four of these motors (4) are installed on each side of an electric circuit (10) which comprises i.a. the electronic components for controlling the servomotors (4). This electrical circuit (10) is also mounted on the said plate (7).

The servomotors (4) are provided in a known manner to control pattern-controlled components (2) for the feeding of yarn for a tufting machine. As this is state-of-the-art and does not form part of the invention, this is not discussed in further detail here. In the pattern-controlled components that control the hooks under the tuft fabric, the servomotors can be replaced by pneumatic actuators. On an Axminster weaving machine the servomotors can, for example, be typically replaced by rotary or linear stepper motors. In a Jacquard machine the servomotors can, for example, be typically replaced by solenoids.

In other textile machines, different numbers of actuators (4) per actuator module (6) may be desired.

The said plate (7) of each yarn feeding module (6) is attachable to the beam (8) of the mounting frame (3, 8). To this end, this plate (7) has screw holes (12) at top and bottom through which screws can be inserted to screw this plate (7) to respective beams (8) of the mounting frame (3, 8). The beams (8) of the mounting frame (3, 8) have a stop (11) with which the upper side of the plate (7) can be aligned for simple positioning of the yarn feeding modules (6) relative to the beams (8) before it is screwed tight. This plate (7) is thermally conductive in order to be able to dissipate the heat of the motors (4) and the electric circuit (10) to the beams (8) which form part of the cooling circuit (5, 8) through which water is flowable.

At top and bottom, each yarn feeding module (6) comprises a guide rib (9) that can engage and slide in a corresponding guide slot (not illustrated) in the beams (8) in order to guide the yarn feeding module (6) relative to the beams (8) during installation in the yarn feeding unit (1).

In this way the yarn feeding modules (6) are located completely alongside the cooling circuit (5, 8) in the yarn feeding unit (1) and are detachable from the cooling circuit (5, 8) without having to interrupt this cooling circuit (5, 8).

The illustrated cooling circuit (5, 8) is provided here for cooling both the motors (4) and the electric circuits (10) of the yarn feeding modules (6). Due to the thermally conductive plates (7), maximum heat from the motors (4) and the electric circuits (10) is discharged to the cooling circuit (5, 8). This cooling circuit (5, 8) can also be provided for the cooling of one or more mechanical parts of the device (1) and/or of other mechanical and/or electrical parts of the textile machine in which this device (1) is installed.

The invention claimed is:

1. Device equipped with pattern-controlled components for at least one of pattern-controlled feeding of yarn for a textile machine and selection of yarn for a textile machine, comprising:

a plurality of actuators;

a mounting frame on which the actuators are detachably installable;

a cooling circuit through which cooling liquid is flowable for the cooling of the actuators, the cooling circuit being at least partially integrated into the mounting frame; and one or more actuator modules of pattern-controlled components, each of the one or more actuator modules comprising one or more of the actuators and each of the one or more actuator modules being detachably installable in the device in order to install the one or more of the actuators contained in each of the one or more actuator modules detachably in the device, wherein the actuators in the device are installed outside the cooling circuit and are mountable so as to be detachable without interrupting the cooling circuit, and wherein the cooling circuit comprises at least one beam through which the cooling liquid is flowable and to which each of the one or more actuator modules is detachably fastenable.

2. Device according to claim 1, characterized in that each actuator module comprises one or more thermally conductive elements to conduct heat from the actuators to the cooling circuit.

3. Device according to claim 2, characterized in that each actuator module is detachably installable in the device by means of the one or more thermally conductive elements.

4. Device according to claim 2, characterized in that each actuator is installed at least partially separate from the one or more thermally conductive elements.

5. Device according to claim 4, characterized in that at least one side of each actuator is installed facing away from the one or more thermally conductive elements.

6. Device according to claim 5, characterized in that each actuator borders on the one or more thermally conductive elements on only one side.

7. Device according to claim 2, characterized in that each actuator module comprises a thermally conductive plate as said thermally conductive element.

8. Device according to claim 7, characterized in that the thermally conductive plate extends in each actuator module like a flange relative to each actuator of the actuator module.

9. Device according to claim 7, characterized in that each actuator module, all actuators and the electrical components are fastened to the thermally conductive plate.

10. Device according to claim 1, wherein each actuator module has a guide rib or guide slot and that the mounting frame comprises a corresponding guide slot or guide rib to guide the actuator module during installation of said module.

11. Device according to claim 1, characterized in that this device comprises one or more electrical components and that the cooling circuit is provided for cooling these electrical components.

12. Device according to claim 11, characterized in that each actuator module comprises one or more said electrical components.

13. Device according to claim 12, characterized in that the actuators of each actuator module are installed on both sides of the electrical components of each actuator module.

14. Device according to claim 1, characterized in that the cooling liquid is water.

15. Jacquard machine comprising a device equipped with pattern-controlled components for pattern-controlled positioning of yarn, wherein the device comprises:

a plurality of actuators;

a mounting frame on which the actuators are detachably installable;

a cooling circuit through which cooling liquid is flowable for the cooling of the actuators, the cooling circuit being at least partially integrated into the mounting frame; and one or more actuator modules of pattern-controlled components, each of the one or more actuator modules comprising one or more of the actuators and each of the one or more actuator modules being detachably installable in the device in order to install the one or more of the actuators contained in each of the one or more actuator modules detachably in the device, wherein the actuators in the device are installed outside the cooling circuit and are mountable so as to be detachable without interrupting the cooling circuit, and wherein the cooling circuit comprises at least one beam through which the cooling liquid is flowable and to which each of the one or more actuator modules is detachably fastenable.

16. Textile machine comprising a device equipped with pattern-controlled components, wherein the device comprises:

a plurality of actuators;

a mounting frame on which the actuators are detachably installable;

a cooling circuit through which cooling liquid is flowable for the cooling of the actuators, the cooling circuit being at least partially integrated into the mounting frame; and one or more actuator modules of pattern-controlled components, each of the one or more actuator modules comprising one or more of the actuators and each of the one or more actuator modules being detachably installable in the device in order to install the one or more of the actuators contained in each of the one or more actuator modules detachably in the device, wherein the actuators in the device are installed outside the cooling circuit and are mountable so as to be detachable without interrupting the cooling circuit, and wherein the cooling circuit comprises at least one beam through which the cooling liquid is flowable and to which each of the one or more actuator modules is detachably fastenable.

17. Textile machine according to claim 16, characterized in that the cooling circuit is furthermore provided for the cooling of at least one of one or more mechanical parts of the device, one or more mechanical parts of the textile machine, and one or more electrical parts of the textile machine.

* * * * *